United States Patent [19]

Adaniya et al.

[11] 4,064,320

[45] Dec. 20, 1977

[54] CHROMATED ELECTRO-GALVANIZED STEEL SHEET EXCELLENT IN CORROSION RESISTANCE AND PROCESS FOR MANUFACTURING SAME

[75] Inventors: Takeshi Adaniya; Masaru Ohmura, both of Fukuyama, Japan

[73] Assignee: Nippon Kokan Kabushiki Kaisha, Tokyo, Japan

[21] Appl. No.: 662,618

[22] Filed: Mar. 1, 1976

[30] Foreign Application Priority Data

| | | |
|---|---|---|
| Mar. 26, 1975 | Japan | 50-35289 |
| Mar. 26, 1975 | Japan | 50-35290 |
| Jan. 9, 1976 | Japan | 51-1588 |

[51] Int. Cl.[2] ..... B23P 3/00; C25D 5/10; C25D 5/48

[52] U.S. Cl. ..... 428/632; 204/38 R; 204/40; 204/43 Z; 428/659

[58] Field of Search ..... 204/38 R, 40, 41, 43 Z, 204/55 R; 29/195 T, 196.4, 196.5; 428/621, 622, 623, 632, 659

[56] References Cited

U.S. PATENT DOCUMENTS

| | | | |
|---|---|---|---|
| 3,822,118 | 7/1974 | Fukuzuka et al. | 29/183.5 |
| 3,986,843 | 10/1976 | Adaniya et al. | 29/195 |

OTHER PUBLICATIONS

Chemical Abstracts, 63583h, vol. 70, p. 468, (1969).

*Primary Examiner*—G. L. Kaplan
*Attorney, Agent, or Firm*—Flynn & Frishauf

[57] ABSTRACT

A chromated electro-galvanized steel sheet is manufactured by electro-galvanizing a steel sheet in an acidic galvanizing bath containing zinc with or without specified amounts of cobalt, or with specified amounts of cobalt and with at least one of chromium ($Cr^{+3}$, $Cr^{+6}$ or $Cr^{+3}$ and $Cr^{+6}$) and zirconium; then electro-galvanizing in a zinc-based galvanizing bath containing specified amounts of at least one of chromium ($Cr^{+3}$, $Cr^{+6}$ or $Cr^{+3}$ and $Cr^{+6}$), tin and indium; and chromating the resulting steel sheet.

21 Claims, No Drawings

CHROMATED ELECTRO-GALVANIZED STEEL SHEET EXCELLENT IN CORROSION RESISTANCE AND PROCESS FOR MANUFACTURING SAME

FIELD OF THE INVENTION

The present invention relates to a chromated electro-galvanized steel sheet excellent in the bare corrosion resistance and the corrosion resistance after chromating, hardly susceptible of secular degradation of the deep-drawing formability, and having a first galvanizing layer (lower layer) excellent in the bare corrosion resistance and a second galvanizing layer (upper layer) excellent in the adaptability to chromating, and the process for manufacturing same.

BACKGROUND OF THE INVENTION

It is in general inevitable that impurities from a galvanizing apparatus, an electrode, galvanizing bath materials and a steel sheet to be electro-galvanized are entangled into a galvanizing bath during electrogalvanizing operations of the steel sheet. Impurities thus mixed into the galvanizing bath not only causes degradation of the surface quality of the produced galvanizing layer, but also exerts adverse effects on a chromate treatment to be applied thereafter. If, for example, a galvanizing bath contains $Fe^{2+}$ mixed in it as impurities, formation of a chromate film on the galvanizing layer of an electro-galvanized steel sheet is seriously impaired in applying a chromate treatment as the next step, and hence, the amount of deposited chromate is largely reduced. If, furthermore, impurities such as $Cu^{2+}$ and $Ni^{2+}$ are contained in a galvanizing bath, the amount of chromate deposited onto the galvanizing layer of an electro-galvanized steel sheet is small in applying a chromate treatment. Consequently, an intensification of chromate treatment conditions, as described later, cannot increase at all the amount of deposited chromate. As a result, it is impossible to obtain a chromated electro-galvanized steel sheet having a satisfactory corrosion resistance after chromating.

For the purpose of preventing impurities from coming into a galvanizing bath, or removing impurities from a galvanizing bath, it has been usual practice to apply a closer control over impurities in a galvanizing bath, to employ a corrosion resistant material for the construction of a galvanizing apparatus, to remove such impurities as cadmium, lead and copper dissolved in a galvanizing bath by substituting zinc for such impurities through a treatment of the galvanizing bath with zinc powder, or, to cause precipitation of such impurities as copper by suspending an iron plate in a galvanizing bath.

On the other hand, a method for intensifying chromating conditions is conventionally known, which comprises increasing the amount of deposited chromate by increasing the amount of free acid in a chromating bath, with a view to imparting a satisfactory corrosion resistance to an electro-galvanized steel sheet of which the galvanizing layer has been degraded by impurities in the galvanizing bath. The chromating bath in this method has however a strong pickling action because of its increased free acid. This method is therefore defective in that the formation of a chromate film becomes nonuniform or the increased dissolution of zinc into the chromating bath accelerates the degradation of the chromating bath. Even by such an intensification of chromating conditions, therefore, the time before occurrence of white rust in a salt spray test, for example, is not extended so much, and an improvement of the corrosion resistance of a chromated electro-galvanized steel sheet cannot be expected.

In all cases, these conventional measures to prevent impurities from coming into a galvanizing bath, to remove impurities from a galvanizing bath and to intensify chromating conditions are only passive actions aiming at preventing the adaptability to chromating of an electro-galvanized steel sheet from being impaired by impurities mixed in a galvanizing bath. These measures cannot therefore be positive actions imparting a higher corrosion resistance to an electro-galvanized steel sheet by improving its adaptability to chromating.

In view of the foregoing, the following methods have so far been proposed:

1. Method which comprises electro-galvanizing a steel sheet in a galvanizing bath containing added Mo and W (refer to the Japanese Patent Publication No. 25,245/71);
2. Method which comprises electro-galvanizing a steel sheet in a galvanizing bath containing added Co, Mo, W and Fe (refer to the Japanese Patent Publication No. 16,522/72);
3. Method which comprises electro-galvanizing a steel sheet in a galvanizing bath containing added Co, Mo, W, Ni, Sn, Pb and Fe (refer to the Japanese Patent Publication No. 19,979/74);
4. Method which comprises electro-galvanizing a steel sheet in a galvanizing bath containing added 0.05 - 0.3 g/l $Cr^{6+}$ (refer to the Japanese Patent Provisional Publication No. 84,040//73); and
5. Method which comprises electro-galvanizing a steel sheet in a galvanizing bath containing added 0.5 - 1.5 g/l Zr (refer to the Japanese Patent Publication No. 18,202/70).

All these methods (1) to (5) have an object to improve the quality of the galvanizing layer itself of an electro-galvanized steel sheet. The adaptability to chromating of an electro-galvanized steel sheet is not therefore improved by any of these methods, thus leading to no improvement in the corrosion resistance of the electro-galvanized steel sheet after a chromate treatment. Method (4) above (Japanese Patent Provisional Publication No. 84,040/73), in particular, has a drawback in that, because of the addition of $Cr^{6+}$, hydrogen is absorbed into the steel sheet in the initial stage of electro-galvanizing, and this impairs the coating adhesion.

With a view to improving the coating adhesion in said method (4) (Japanese Patent Provisional Publication No. 84,040/73), a process has been proposed (refer to Japanese Patent Provisional Publication No. 98,337/74), which comprises subjecting a steel sheet to a first electrogalvanizing treatment in a galvanizing bath containing Zn only, to form a very thin pure zinc galvanizing layer of a thickness of at least $1 \times 10^{-3}\mu$, in practice of about $0.1\mu$, on the surface thereof; and then, subjecting said electro-galvanized steel sheet with said pure zinc galvanizing layer formed thereon to a second electrogalvanizing treatment in a Zn-based galvanizing bath containing $Cr^{6+}$. In this process, however, the galvanizing film formed on the steel sheet mostly comprises a galvanizing layer formed in a galvanizing bath containing Zn and $Cr^{6+}$. A product obtained by this process is therefore only a steel sheet having a galvanizing layer formed in a galvanizing bath containing Zn and $Cr^{6+}$, after a primer treatment.

In view of the foregoing, a process for manufacturing a chromated electro-galvanized steel sheet has been proposed (refer to the Japanese Patent Provisional Publication No. 102,538/75), with a view to increasing the amount of deposited chromate film by the improvement of the adaptability to chromating of an electro-galvanized steel sheet and thus to improving the corrosion resistance of the electro-galvanized steel sheet after chromating, said process comprising: electro-galvanizing a steel sheet in a Zn-based acidic galvanizing bath containing an additive selected from the group consisting of:

a. $Cr^{3+}$ — 50 - 700 ppm,
b. $Cr^{6+}$ — 50 - 500 ppm, and
c. $Cr^{3+}$ and $Cr^{6+}$ — 50 - 700 ppm, in which $Cr^{6+}$ being 500 ppm at the maximum;

and then subjecting said electro-galvanized steel sheet to a chromate treatment. According to this method, the time before occurrence of white rust is largely extended, but sufficiently satisfactory results are not as yet available in terms of the time before occurrence of red rust.

Under these circumstances, we have previously proposed the following three processes for manufacturing a chromated electro-galvanized steel sheet having a largely improved corrosion resistance (especially the time before the occurrence of red rust), said processes permitting increase in the amount of deposited chromate film in a high-speed line treatment:

a. A process which comprises: subjecting a steel sheet to an electro-galvanizing treatment in a Zn-based acidic galvanizing bath containing at least one additive selected from the group consisting of:
   i. $Cr^{3+}$ — 50 - 700 ppm,
   ii. $Cr^{6+}$ — 50 - 500 ppm,
   iii. $Cr^{3+}$ and $Cr^{6+}$ — 50 - 700 ppm, in which $Cr^{6+}$ being 500 ppm at the maximum,
   iv. In — 10 - 3,000 ppm, and
   v. Zr — 10 - 2,500 ppm; and:
   vi. Co — 50 - 10,000 ppm, to form a galvanizing layer on the surface thereof; and then, subjecting said electro-galvanized steel sheet with said galvanizing layer formed thereon to a conventional chromate treatment (refer to the Japanese Patent Application No. 8,627/75);

b. A process which comprises: subjecting a steel sheet to an electro-galvanizing treatment in a Zn-based acidic galvanizing bath containg one additive selected from the group consisting of:
   i. $Cr^{3+}$ — 50 - 700 ppm,
   ii. $Cr^{6+}$ — 50 - 500 ppm, and
   iii. $Cr^{3+}$ and $Cr^{6+}$ — 50 - 700 ppm, in which $Cr^{6+}$ being 500 ppm at the maximum;

and at least one additive selected from the group consisting of:
   iv. Sn — 10 - 5,000 ppm, and
   v. In — 10 - 3,000 ppm, to form a galvanizing layer on the surface thereof; and then, subjecting said electro-galvanized steel sheet with said galvanizing layer formed thereon to a conventional chromate treatment (refer to the Japanese Patent Application No. 8,626/75); and c. A process which comprises: subjecting a steel sheet to an electro-galvanizing treatment in a Zn-based acidic galvanizing bath containing at least one additive selected from the group consisting of:
   i. In — 10 - 3,000 ppm, and
   ii. Sn — 10 - 5,000 ppm, to form a galvanizing layer on the surface thereof; and then, subjecting said electro-galvanized steel sheet with said galvanizing layer formed thereon to a conventional chromate treatment (refer to the Japanese Patent Application No. 32,250/75).

All the above-mentioned methods (a), (b) and (c) have an object to form a galvanizing layer excellent in the adaptability to chromating on the surface of a steel sheet by adding at least one additive into an acidic galvanizing bath, and enable to obtain an electro-galvanized steel sheet excellent in the adaptability to chromating. However, in terms of the corrosion resistance of the galvanizing layer itself on an electro-galvanized steel sheet before chromating (hereafter referred to as the "bare corrosion resistance"), an electro-galvanized steel sheet produced by any of methods (b) and (c) mentioned above is not always superior to an electro-galvanized steel sheet having a galvanizing layer obtained by a conventional electro-galvanizing treatment with the use of a galvanizing bath not containing such additives as mentioned above (hereafter referred to as the "pure zinc galvanizing layer"). For example, a galvanizing bath, when containing too much Cr with a view to largely improving the adaptability to chromating of an electro-galvanized steel sheet, causes precipitation of much Cr on the interface between the steel sheet and the galvanizing layer thereof, and thus impairs the adhesion of the galvanizing layer. A galvanizing bath containing Sn, on the other hand, tends to cause pinholes in the resulting galvanizing layer, which may lead to drawbacks such as the degradation of the bare corrosion resistance of the electro-galvanized steel sheet thus obtained.

The amount of deposited zinc layer is in general smaller in an electro-galvanized steel sheet than in a hot-dip galvanized steel sheet. In terms of the overall corrosion resistance of a chromated electro-galvanized steel sheet as a whole after a chromate treatment, however, the ratio of the corrosion resistance of the chromate film to the overall corrosion resistance reportedly accounts for about 50%. The effect of the chromate film of an electro-galvanized steel on the overall corrosion resistance is therefore greater than that in a hot-dip galvanized steel sheet, and plays a very important role on the corrosion resistance.

More specifically, the overall corrosion resistance of a chromated electro-galvanized steel sheet is based on the cooperation of the corrosion resistance of the galvanizing layer therof as defined as the bare corrosion resistance and the corrosion resistance of the chromate film thereof. Even if the galvanizing layer has a low bare corrosion resistance, therefore, a chromated electro-galvanized steel sheet shows an excellent corrosion resistance as a whole, when the galvanizing layer has a high adaptability to chromating. In contrast, when the corrosion resistance of the chromate film is degraded with time, or when the galvanizing layer is exposed by a damage to the chromate film, a low bare corrosion resistance of the galvanizing layer accelerates the occurrence of rust and leads to a lower overall corrosion resistance of a chromated electro-galvanized steel sheet as a whole.

As is clear from the foregoing, a chromated electro-galvanized steel sheet is required to have an excellent bare corrosion resistance of the galvanizing layer thereof as well as an excellent corrosion resistance of the chromate film thereof. Degradation of any of these corrosion resistances impairs the overall corrosion resistance of said chromated electro-galvanized steel sheet as a whole.

A chromated electro-galvanized steel sheet obtained by method (a) mentioned above has a higher bare corrosion resistance and a considerably improved corrosion resistance after a chromate treatment under the cooperative effects of such additives as Co, Cr, In and Zr in the galvanizing bath, as compared with a chromated electro-galvanized steel sheet obtained by any of methods (b) and (c) mentioned above. It is however inevitable that the galvanizing layer of a chromated electro-galvanized steel sheet obtained by method (a), which contains Co, has a smaller amount of deposited chromate film as compared with a chromated electro-galvanized steel sheet having a galvanizing layer not containing Co, and the quality of the former may therefore be degraded with time.

More specifically, an electro-galvanized steel sheet has usually a press formability different from that of an ordinary cold rolled steel sheet not galvanized, and the press formability of an electro-galvanized steel sheet depends also on the application of a chemical treatment and the type thereof. In addition, an electrogalvanized steel sheet is characterized in that it has a lower stretch formability but a higher deep-drawing formability.

Chromated electro-galvanized steel sheets with amounts of deposited chromate film of 40mg/m$^2$ and 9mg/m$^2$, respectively, were manufactured by chromating electrogalvanized steel sheets each having a conventional galvanizing layer not containing any additional element in a commercially available conventional chromating solution. On these steel sheets, the corrosion resistance and the deep-drawing formability were investigated at moments immediately after the manufacture and after a six-month in-door holding in a packaged form. As a result, almost no difference was observed in the corrosion resistance between the two sheets both immediately after the manufacture and after the lapse of six months. With regard to the deep-drawing formability, however, although there was no difference between the two sheets immediately after the manufacture, a serious degradation was observed in the one with an amount of deposited chromate film of 9mg/m$^2$ after the lapse of six months.

It was thus found that, depending upon the amount of deposited chromate film, the deep-drawing formability of chromated electro-galvanized steel sheets show a difference with time. The reasons are not clearly known, since the press formability of an electron-galvanized steel sheet shows complicated behaviors depending on the presense of a chemical treatment, the type of the chemical treatment applied and the lapse of time, unlike that of a cold rolled steel sheet not galvanized. However, it is at least evident that the amount of deposited chromate film is significant.

It may be concluded from these facts that the best way for preventing the secular degradation of the deep-drawing formability of a chromated electro-galvanized steel sheet is to increase the amount of deposited chromate film.

As mentioned above, it is particularly necessary for a chromated electro-galvanized steel sheet to be excellent in the bare corrosion resistance of the galvanizing layer and the corrosion resistance of the chromate film. It should furthermore have an amount of deposited chromate film sufficient to prevent the secular change of the deep-drawing formability thereof. However, a chromated electro-galvanized steel sheet provided with all such performances and a manufacturing process thereof have not as yet been proposed.

SUMMARY OF THE INVENTION

An object of the present invention is therefore to provide a chromated electro-galvanized steel sheet with two galvanizing layers, excellent in the bar corrosion resistance of the galvanizing layer and the corrosion resistance of the chromate film, with a deep-drawing formability not being degraded by secular change, and a process for manufacturing same.

In accordance with one of the features of the present invention, there is provided a chromated electrogalvanized steel sheet and a process for manufacturing same, which comprises:

subjecting a steel sheet to a first electro-galvanizing treatment under conventional galvanizing conditions in any of the following acidic galvanizing baths:

1. A conventional acidic galvanizing bath containing Zn only;
2. A Zn-based acidic galvanizing bath containing 50 -10,000 ppm Co; and
3. A Zn-based acidic galvanizing bath containing
   i. Co — 50 - 10,000 ppm;

and at least one additive selected from the group consisting of:

ii. $Cr^{3+}$ — 50 - 700 ppm,
iii. $Cr^{6+}$ — 50 - 500 ppm,
iv. $Cr^{3+}$ and $Cr^{6+}$ 13 50 - 700 ppm, in which $Cr^{6+}$ being 500 ppm at the maximum, and
v. Zr — 10 - 2,500 ppm, to form on the surface of said steel sheet a first galvanizing layer excellent in the bare corrosion resistance; and then, subjecting said electro-galvanized steel sheet with said first galvanizing layer formed thereon to a second electro-galvanizing treatment under conventional galvanizing conditions in a Zn-based acidic galvanizing bath containing at least one additive selected from the group consisting of:

a. $Cr^{3}+$ — 50 - 700 ppm,
b. $Cr^{6+}$ — 50 - 500 ppm,
c. $Cr^{3+}$ and $Cr^{6+}$ — 50 - 700 ppm, in which $Cr^{6+}$ being 500 ppm at the maximum,
d. Sn — 10 - 5,000 ppm, and
e. In — 10 - 3,000 ppm, to form on said first galvanizing layer a second galvanizing layer of an amount of at least 0.2 g/m$^2$ excellent in the adaptability to chromating; and then, subjecting said electro-galvanized steel sheet with said first and said second galvanizing layers formed thereon to a conventional chromate treatment to form on said second galvanizing layer a chromate film.

DETAILED DESCRIPTION OF PREFERRED EMBODIMENTS

From the aforementioned point of view, the inventors have carried out an extensive study, in recognition of the fact that it is very difficult, with a single galvanizing layer, to obtain a chromated electro-galvanized steel sheet excellent in the bare corrosion resistance of the galvanizing layer and the corrosion resistance of the chromate film and having an amount of deposited chromate film sufficient to prevent degradation of the deep-drawing formability caused by secular change, and also in view of the fact that the bare corrosion resistance is a property which the galvanizing layer itself should be provided with; the adaptability to chromating is a property to which only the upper surface of a galvanizing layer is related; and the addition of certain additional elements throughout an entire galvanizing layer is disadvantageous in economics as well as in operation. We have found as a result the possibility of obtaining a chromated electro-galvanized steel sheet excellent in the bare corrosion resistance of the galvanizing layer and the corrosion resistance of the chromate film and having an amount of deposited chromate film sufficient to prevent degradation of the deep-drawing formability caused by secular change, by subjecting a steel sheet to a first electrogalvanizing treatment under conventional galvanizing conditions in a conventional acidic galvanizing bath containing Zn only, to form on the surface of said steel sheet a first galvanizing layer comprising Zn only, excellent in the bare corrosion resistance; and then, subjecting said electro-galvanized steel sheet with said first galvanizing layer formed thereon to a second electro-galvanizing treatment under conventional galvanizing conditions in a Zn-based acidic galvanizing bath containing at least one additive selected from the group consisting of:

1. $Cr^{3+}$ — 50 - 700 ppm,
2. $Cr^{6+}$ — 50 - 500 ppm,
3. $Cr^{3+}$ and $Cr^{6+}$ — 50 - 700 ppm, in which $Cr^{6+}$ being 500 ppm at the maximum,
4. Sn — 10 - 5,000 ppm, and
5. In — 10 - 3,000 ppm, to form on said first galvanizing layer a second galvanizing layer of an amount of at least 0.2 g/m$^2$ excellent in the adaptability to chromating containing CR, Sn and/or In, which shows an excellent adaptability to chromating, in the form of oxides and/or hydroxides; and then, subjecting said electro-galvanized steel sheet with said first and said second galvanizing layers formed thereon to a conventional chromate treatment to form on said second galvanizing layer a chromate film. The process comprising the above-mentioned steps is hereafter referred to as the "first process" of the present invention.

The first galvanizing layer (lower layer) in the first process of the present invention, being a pure zinc galvanizing layer, is free from the influence of additional elements, and therefore shows an excellent bare corrosion resistance as in a conventional pure zinc galvanized steel sheet. Moreover, the second galvanizing layer (upper layed presents an excellent adaptability to chromating under the effect of the additional elements described later. According to the first process of the present invention, therefore, it is possible to obtain a chromated electro-galvanized steel sheet having satisfactory properties as mentioned above.

The galvanizing bath used for the first electro-galvanizing treatment for forming the first galvanizing layer (pure zinc galvanizing layer) in the first process of the present invention may be known conventional acidic galvanizing bath. More specifically, zinc sulfate ($ZnSO_4 \cdot 7\ H_2O$) or zinc chloride ($ZnCl_2$) is applicable as a main Zn source; ammonium chloride ($NH_4Cl$) or other ammonium salt ($NH_4X$), as an conductive assistant; and sodium acetate ($CH_3COONa$) or sodium succinate ($(CH_2COONa)_2 \cdot 6\ H_2O$), as pH buffer. For example, an acidic galvanizing bath of a pH of about 4, containing Zn $SO_4 \cdot 7\ H_2O$: 440 g/l; $ZnCl_2$: 90 G/l; $NH_4Cl$: 12 g/l; and $(CH_2COONa)_2 \cdot 6\ H_20$; 12 g/l, is well applicable as the galvanizing bath for forming the first galvanizing layer in the first process of the present invention without any special treatment.

Conditions for the first electro-galvanizing treatment for forming the first galvanizing layer in the first process of the present invention may also be conventional ones, without the necessity of any modification. For example, a steel sheet may be electro-galvanized at a bath temperature of about 40° - 60° C and with a current density of about 20 - 60 A/dm$^2$.

Then, as the galvanizing bath used for the second electro-galvanizing treatment for forming the second galvanizing layer on the first galvanizing layer (pure zinc galvanizing layer) in the first process of the present invention, a galvanizing bath based on an acidic galvanizing bath of the same chemical composition as that of the galvanizing bath used for the first electro-galvanizing treatment for forming the first galvanizing layer, and added with at least one additive selected from the group consisting of:

1. $Cr^{3+}$ — 50 - 700 ppm,
2. $Cr^{6+}$ 50 - 500 ppm,
3. $Cr^{3+}$ and $Cr^{6+}$ 50 - 700 ppm, in which $Cr^{6+}$ being 500 ppm at the maximum,
4. Sn — 10 - 5,000 ppm, and
5. In — 10 - 3,000 ppm, is used.

Now, the following paragraphs explain the effects of the above-mentioned elements to be added and the reasons why the amounts of these additives are limited as mentioned above.

1. $Cr^{3+}$ and $Cr^{6+}$

In the galvanizing layer of an electro-galvanized steel sheet, formed in a galvanizing bath containing $Cr^{3+}$ and/or $Cr^{6+}$, $Cr^{3+}$ and $CR^{6+}$ are chemically absorbed in the form of oxides and/or hydroxides of Cr into said galvanizing layer, which are estimated to serve as nuclei on the formation of a chromate film and promote the growth of the chromate film.

A $Cr^{3+}$ content of over 700 ppm in a galvanizing bath is not desirable because of a portion remaining undissolved in the galvanizing bath. Also, a $Cr^{6+}$ content of over 500 ppm in a galvanizing bath impairs the adhesion of zinc to steel sheet and produces irregularities in the galvanizing layer, thus giving an unfavorable external appearance to the electro-galvanized steel sheet. Furthermore, an excessive content of $Cr^{6+}$ in a galvanizing bath inhibits formation of a galvanizing film.

On the other hand, a content of $Cr^{3+}$ and/or $Cr^{6+}$ of under 50 ppm, posing no problems in the formation of a galvanizing film, the adhesion of the galvanizing film to a steel sheet, and the external appearance of an electro-galvanized steel sheet, gives no improvement in the adaptability to chromating of an electro-galvanized steel sheet.

It is desirable to use a water-soluble compound such as chromium sulfate, chromium nitrate or chromium-ammonium sulfate, as an additive for adding $Cr^{3+}$ into a galvanizing bath, and a water-soluble compound such as bichromic acid, chromic acid, or an alkali or an ammonium salt thereof, as an additive for adding $Cr^{6+}$. Because $Cr^{3+}$ cannot be easily dissolved in a galvanizing bath, it is advisable to dissolve in advance said additive in hot water and add the solution into the galvanizing bath to facilitate dissolution of $Cr^{3+}$ into the galvanizing bath.

2. Sn and In

Steel sheets were tentatively electro-galvanized, one in a conventional acidic galvanizing bath based on zinc sulfate ($ZnSO_4$) and added with ammonium chloride and pH buffer, and the second one in an acidic galvanizing bath prepared by adding tin sulfate ($SnSO_4$) into said conventional bath, and the third one in an acidic galvanizing bath prepared by adding indium sulfate ($In_2(SO_4)_3$) into said conventional bath, at a current density of 45 A/dm², so as to give an amount of deposited zinc of 20 g/m²; and then subjected to a chromate treatment by dipping said electro-galvanized steel sheets in a commercial reactive-type chromating solution. Measurement of the natural electric potential on said chromated electro-galvanized steel sheets have shown that the chromated electro-galvanized steel sheet treated in the Sn-containing or in the In-containing bath has a far higher (base) natural electric potential than in that treated in the galvanizing bath containing none of these elements. There was almost no difference in the natural electric potential between the electro-galvanized steel sheet treated in the Sn-containing galvanizing bath and that treated in the In-containing bath, the former showing a slightly higher (base) natural electric potential. These results indicate that the surface of a galvanizing layer formed in a galvanizing bath containing Sn or In is more activated (base) than that of a galvanizing layer formed in a galvanizing bath containing none of these elements.

Furthermore, the amount of deposited chromate film of the above-mentioned chromated electro-galvanized steel sheet treated in the Sn-containing galvanizing bath, as measured by fluorescent X-ray, was 2.5 times that treated in the galvanizing bath containing none of Sn and In, and that of the chromated electro-galvanized steel sheet treated in the In-containing galvanizing bath was 2.1 time the latter. This permitted confirmation of the fact that the surface activation effect by Sn and/or In causes increase in the amount of deposited chromate film on the surface of a galvanizing layer.

However, an Sn content of over 5,000 ppm in a galvanizing bath causes precipitation of an undissolved portion in the galvanizing bath. In spite of the deposition of zinc, the impaired adhesion of zinc to a steel sheet prevents the formation of a galvanizing film. In the case of an Sn content of under 10 ppm, on the other hand, there is observed no improvement in the adaptability to chromating of a galvanized steel sheet.

Also, an In content of over 3,000 ppm in a galvanizing bath, posing no problems in the formation of a galvanizing layer, the adhesion of the galvanizing layer and the adaptability to chromating of an electro-galvanized steel sheet, causes formation of deposits on a galvanizing electrode, thus making it difficult to carry on galvanizing operations. An In content of under 10 ppm, on the other hand, brings about no improvement in the adaptability to chromating of an electro-galvanized steel sheet.

Preferable additives to add Sn in a galvanizing bath include such water-soluble compounds as stannous sulfate, stannic sulfate, stannous chloride and stannic chloride, and preferable additives to add In include such water-soluble compounds as indium sulfate and indium chloride.

Conditions for the second electro-galvanizing treatment for forming the second galvanizing layer in the first process of the present invention may be the same as those for the first electro-galvanizing treatment mentioned above for forming the first galvanizing layer. For example, an electro-galvanized steel sheet with the first galvanizing layer formed thereon may be subjected to a second electro-galvanizing treatment at a bath temperature of about 40° - 60° C and with a current density of about 20 - 60 A/dm² in an acidic galvanizing bath containing at least one of the above-mentioned additives, to form the second galvanizing layer on said first galvanizing layer.

The thickness of the second galvanzing layer in the first process of the present invention may be very small: a thickness of at least 0.2 g/m² is sufficient. With a thickness of the second galvanizing layer of under 0.2 g/m², no improvement is obtained in the adaptability to chromating of an electro-galvanized steel sheet. This is considered attributable to the fact that, in the case of an amount of deposited second galvanizing layer of under 0.2 g/m², the second galvanizing layer cannot completely cover the above-mentioned first galvanizing layer, and even if it can, its amount is too small to achieve necessary chromating reactions.

In the first process of the present invention, therefore, the thickness of the first galvanizing layer (pure zinc galvanizing layer) may be decided in accordance with the required thickness of the galvanizing layer for a product electro-galvanized steel sheet; one has only to make the total thickness of the first and the second galvanizing layers equal to the required galvanizing layer thickness of a product.

The first and the second electro-galvanizing treatments in the first process of the present invention are carried out as mentioned above. In applying an electro-galvanizing, it is a usual practice to pass a steel sheet successively through several galvanizing tanks installed in succession. In the first process of the present invention, therefore, one has only to fill all the galvanizing tanks with an acidic galvanizing bath of the conventional chemical composition as a pure zinc galvanizing bath, i.e., an acidic galvanizing bath having the above-mentioned chemical composition used for the first galvanizing treatment for forming a first galvanizing layer, and to add the above-mentioned additives to only the bath of the final galvanizing tank. The first process of the present invention is therefore superior also in economics to the conventional process in which additives should be added to all the galvanizing baths.

Conditions for a chromate treatment of an electro-galvanized steel sheet following said first and second electro-galvanizing treatments in the first process of the present invention may be conventional ones. For example, an electro-galvanized steel sheet with first and second galvanizing layers formed thereon may be chromated in a chromating bath containing $CrO_3$: about 5 - 20 g/l with slight amounts of phosphoric and sulfuric acids as additives at a bath temperature of about 35° - 45° C for about 2 to 8 seconds.

As a result of a further study, the inventors have found the possibility of obtaining the first galvanizing layer superior in the bare corrosion resistance to the first galvanizing layer (a pure zinc galvanizing layer) produced by the first process of the present invention, and hence of obtaining a chromated electro-galvanized steel sheet excellent in the bare corrosion resistance of the galvanizing layer and the corrosion resistance of the chromate film and having an amount of deposited chromate film sufficient to prevent secular degradation of the deep-drawing formability, by subjecting a steel sheet to the first electro-galvanizing treatment in a Zn-based acidic galvanizing bath containing 50–10,000 ppm Co to form on the surface of said steel sheet the first galvanizing layer containing Co excellent in the bare corrosion resistance in the form of oxides and/or hydroxides; and then, subjecting said electro-galvanized steel sheet to the second electro-galvanizing treatment and the chromate treatment perfectly identical with the second electro-galvanizing treatment and the chromate treatment mentioned in the first process of the present invention. The process comprising the above-mentioned steps is hereafter referred to as the "second process" of the present invention.

The first galvanizing layer (lower layer) in the second process of the present invention, which is based on Zn and contains Co excellent in the bare corrosion resistance as described later in the form of oxides and/or hydroxides, is free from the effect of the other additional additives, and is hence superior in the bare corrosion resistance to the first galvanizing layer (pure zinc galvanizing layer) in the first process of the present invention. Furthermore, the second galvanizing layer (upper layer), having the same chemical composition as that of the second galvanizing layer in the first process of the present invention mentioned above, presents an excellent adaptability to chromating as in the first process of the present invention. According to the second process of the present invention, therefore, it is possible to obtain a chromated electro-galvanized steel sheet having satisfactory properties as mentioned above.

As the galvanizing bath used for the first electro-galvanizing treatment for forming the first galvanizing layer in the second process of the present invention, an acidic galvanizing bath is used, which is prepared by adding 50 – 10,000 ppm Co into an acidic galvanizing bath having the same chemical composition as that of the galvanizing bath used for the first electro-galvanizing treatment for forming the first galvanizing layer in the first process of the present invention.

Now, the following paragraphs explain the effects of Co to be added and the reasons why the amount of added Co is limited as mentioned above.

Co is considered to be present in the form of oxides and/or hydroxides in the galvanizing layer of an electro-galvanized steel sheet, passivate the surface of the galvanizing layer and thus inhibit dissolution of Zn, improving the bare corrosion resistance of said galvanizing layer.

Two steel sheets were tentatively electro-galvanized, one in a conventional acidic galvanizing bath based on zinc sulfate ($ZnSO_4$) and added with ammonium chloride ($NH_4Cl$) and a pH buffer, and the other in another acidic galvanizing bath prepared by adding cobalt sulfate ($CoSO_4$) into said conventional bath, at a current density of 45A/dm$^2$, so as to give an amount of deposited zinc of 20g/m$^2$; and then subjected to a chromate treatment by dipping said electro-galvanized steel sheets in a commercial reactive-type chromating solution. Measurement of the natural electric potential on said chromated electro-galvanized steel sheets have shown that the chromated electro-galvanized steel sheet treated in the Co-containing galvanizing bath had a far lower natural electric potential (noble) than in that treated in the galvanizing bath not containing Co. This indicates that the addition of Co renders a galvanizing layer inactive (noble). The amount of deposited chromate film of the chromated electro-galvanized steel sheet having the Co-containing galvanizing layer, as measured by fluorescent X-ray, was only about one fifth that in the chromated electro-galvanized steel sheet having a galvanizing layer not containing Co. This suggests that an electro-galvanized steel sheet with a Co-containing galvanizing layer has a lower adaptability to chromating.

As described above, Co is an element very favorable in improving the bare corrosion resistance of an electro-galvanized steel sheet by passivating the galvanizing layer thereof, whereas Co seriously impairs the adaptability to chromating of a galvanizing layer. In the second process of the present invention, therefore, only the first galvanizing layer (lower layer) contains Co so as to make fullest use of the advantage of Co in contributing to the improvement of the bare corrosion resistance.

However, a galvanizing bath, when containing too much Co, not only causes a non-uniform dissolution of a zinc electrode, but also causes precipitation of much oxides in the resulting galvanizing layer, which blacken the galvanizing layer and impairs the product quality. A Co content of a galvanizing bath of over 10,000 ppm thus degrades the adaptability to chromating and the external appearance of an electro-galvanized steel sheet, and no improvement is observed in its bare corrosion resistance. It is therefore necessary to limit the Co content to 10,000 ppm at the maximum. At a Co content of under 50 ppm, on the other hand, it is impossible to obtain a desired bare corrosion resistance of a galvanizing layer itself.

It is desirable to use a water-soluble compound such as cobalt sulfate, cobalt chloride or cobalt acetate, as an additive for adding Co into a galvanizing bath.

Conditions for the first electro-galvanizing treatment for forming the first galvanizing layer (Co-containing galvanizing layer) in the second process of the present invention, being the same as those for the first electro-galvanizing treatment for forming the first galvanizing layer (pure zinc galvanizing layer) in the first process of the present invention, are not described here.

The second electro-galvanizing treatment for forming the second galvanizing layer on the first galvanizing layer (Co-containing galvanizing layer), the thickness of the second galvanizing layer, and the chromate treatment of the electro-galvanized steel sheet following the second electro-galvanizing treatment in the second process of the present invention, all being the same as the second electro-galvanizing treatment for forming the second galvanizing layer on the first galvanizing layer (pure zinc galvanizing layer), the thickness of the second galvanizing layer and the chromate treatment of the electro-galvanized steel sheet following the second electro-galvanizing treatment in the first process of the present invention, are not described here.

As a result of a further study, we have found the possibility of obtaining the first galvanizing layer superior in the bare corrosion resistance to the first galvanizing layer (a pure zinc galvanizing layer or a Co-containing galvanizing layer) produced by the first process or the second process of the present invention, and hence of obtaining a chromated electro-galvanized steel sheet excellent in the bare corrosion resistance of the galvanizing layer and the corrosion resistance of the chromate film and having an amount of deposited chromate film sufficient to prevent secular degradation of the deep-drawing formability, by subjecting a steel sheet to the first electro-galvanizing treatment in a Zn-based acidic galvanizing bath containing:

i. Co — 50 – 10,000 ppm;

and at least one additive selected from the group consisting of:

ii. $Cr^{3+}$ — 50 - 700 ppm, iii. $Cr^{6+}$ — 50 - 500 ppm, iv. $Cr^{3+}$ and $Cr^{6+}$ — 50 - 700 ppm, in which $Cr^{6+}$ being 500 ppm at the maximum, and v. Zr — 10 - 2,500 ppm, to form on the surface of said steel sheet the first galvanizing layer containing Co, Cr and/or Zr (Co being indispensable) excellent in the bare corrosion resistance in the form of oxides and/or hydroxides; and then, subjecting said electro-galvanized steel sheet to the second electro-galvanizing treatment and the chromate treatment perfectly identical with the second electro-galvanizing treatment and the chromate treatment in the first process of the present invention. The process comprising the above-mentioned steps is hereafter referred to as the "third process" of the present invention.

The first galvanizing layer (lower layer) in the third process of the present invention, which is based on Zn and contains Co, Cr and/or Zr (Co being indispensable) excellent in the bare corrosion resistance as described later in the form of oxides and/or hydroxides, is superior in the bare corrosion resistance to the first galvanizing layer (a pure zinc galvanizing layer or a Co-containing galvanizing layer) in the first process or the second process of the present invention. Furthermore, the second galvanizing layer (upper layer), having the same chemical composition as that of the second galvanizing layer in the first process of the present invention mentioned previously, presents an excellent adaptability to chromating as in the first process of the present invention. According to the third process of the present invention, therefore, it is possible to obtain a chromated electro-galvanized steel sheet having satisfactory properties as mentioned above.

As the galvanizing bath used for the first electro-galvanizing treatment for forming the first galvanizing layer in the third process of the present invention, an acidic galvanizng bath is used, which is prepared by adding i. Co — 50 -0 10,000 ppm;

and at least one additive selected from the group consisting of:

ii. $Cr^{3+}$ — 50 - 700 ppm, iii. $Cr^{6+}$ — 50 - 500 ppm, iv. $Cr^{3+}$ and $Cr^{6+}$ — 50 - 700 ppm, in which $Cr^{6+}$ being 500 ppm at the maximum, and v. Zr — 10 - 2,500 ppm, into an acidic galvanizing bath having the same chemical composition as that of the galvanizing bath used for the first electro-galvanizing treatment for forming the first galvanizing layer in the first process of the present invention.

Now, the following paragraphs explain the effects of the above-mentioned elements to be added into the acidic galvanizing bath used for the first electro-galvanizing treatment for forming the first galvanizing layer in the third process of the present invention and the reasons why the amounts of these additives are limited as mentioned above.

1. Co

The effects of the addition of Co and the reason why the amount of added Co is limited as mentioned above, being the same as those described in detail with regard to the acidic galvanizing bath used for the first electro-galvanizing treatment for forming the first galvanizing layer in the second process of the present invention, are not explained here.

2. $Cr^{3+}$ and $Cr^{6+}$

In the galvanizing layer of an electro-galvanized steel sheet, formed in an acidic galvanizing bath containing $Cr^{3+}$ and/or $Cr^{6+}$, $Cr^{3+}$ and/or $Cr^{6+}$ are chemically absorbed in the form of oxides and/or hydroxides of Cr into the galvanizing layer, and show the same effects as in a chemical treatment of the galvanizing layer. The addition of Cr therefore permits improvement of the bare corrosion resistance of the galvanizing layer. Moreover, the coexistence of Cr and the above-mentioned Co in a galvanizing layer brings about a further improvement of the bare corrosion resistance thereof under the cooperative effect of Cr and Co.

A $Cr^{3+}$ content of over 700 ppm in a galvanizing bath is not desirable because of a portion remaining undissolved in the galvanizing bath. Also, a $Cr^{6+}$ content of over 500 ppm in a galvanizing bath impairs the adhesion of zinc to steel sheet and produces irregularities in the galvanizing layer, thus giving an unfavorable external appearance to the electro-galvanized steel sheet. Furthermore, an excessive content of $Cr^{6+}$ in a galvanizing bath inhibits formation of a galvanizing film.

On the other hand, a content of $Cr^{3+}$ and/or $Cr^{6+}$ of under 50 ppm, posing no problems in the formation of a galvanizing film, the adhesion of the galvanizing film to a steel sheet and the external appearance of an electro-galvanized steel sheet, gives no improvement in the adaptability to chromating of an electro-galvanized steel sheet.

It is desirable to use a water-soluble compound such as chromium sulfate, chromium nitrate or chromium-ammonium sulfate, as an additive for adding $Cr^{3+}$ into a galvanizing bath, and a water-soluble compound such as bichromic acid, chromic acid, or an alkali or an ammonium salt thereof, as an additive for adding $Cr^{6+}$. Because $Cr^{3+}$ cannot be easily dissolved in a galvanizing bath, it is advisable to dissolve in advance said additive in hot water and add the solution into the galvanizing bath to facilitate dissolution of $Cr^{3+}$ into the galvanizing bath.

3. Zr

As in the case of Cr, the coexistence of Zr and Co in a galvanizing layer improves the bare corrosion resistance of an electro-galvanized steel sheet under the cooperative effect of Cr and Co.

However, a Zr content in a galvanizing bath of over 2,500 ppm is not desirable because of the tendency of producing precipitates in the galvanizing bath. If the Zr content is under 10 ppm, on the other hand, no improvement is obtained in the bare corrosion resistance and the adaptability to chromating of an electro-galvanized steel sheet.

It is desirable to use a water-soluble compound such as zirconium sulfate or zirconium chloride, as an additive for adding Zr into the galvanizing bath.

Conditions for the first galvanizing treatment for forming the first galvanizing layer in the third process of the present invention, being the same as those for the first electro-galvanizing treatment for forming the first galvanizing layer in the first process of the present invention, are not described here.

The second electro-galvanizing treatment for forming the second galvanizing layer on the first galvanizing layer, the thickness of the second galvanizing layer and the chromate treatment of the electro-galvanized steel sheet following the second electro-galvanizing treatment in the third process of the present invention, all being the same as the second electro-galvanizing treatment for forming the second galvanizing layer on the first galvanizing layer, the thickness of the second galvanizing layer and the chromate treatment of the electro-galvanized steel sheet following the second electro-galvanizing treatment in the first process of the present invention, are not described here.

Now, the present invention is described more in detail with reference to examples in comparison with some cases for comparison.

EXAMPLE A

Example A is an embodiment of the first process of the present invention.

A steel sheet was subjected to the first electro-galvanizing treatment under the following conditions:

a. Chemical composition of acidic galvanizing bath:

$ZnSO_4 \cdot 7H_2O$:440 g/l,
$ZnCl_2$:90 g/l,
$NH_4Cl$:12 g/l,
$(CH_2COONa)_2 \cdot 6H_2O$:12 g/l, b. Conditions for electro-galvanizing treatment:

Cathodic current density:45 A/dm$^2$,
Bath temperature:50° C,
pH:4.0;

to form a first galvanizing layer on the surface of said steel sheet. Then, said electro-galvanized steel sheet with said first galvanizing layer formed thereon was subjected to the second electro-galvanizing treatment in a bath prepared by adding $Cr^{3+}$, $Cr^{6+}$, Sn and/or In in amounts shown in the second column of Table 1 below into an acidic galvanizing bath having the chemical composition given in (a) above under the conditions given in (b) above, to form a second galvanizing layer on said first galvanizing layer. In Comparisons 1 to 4 in Table 1, however, a steel sheet was subjected, without applying the above-mentioned second electro-galvanizing treatment, to only a single electro-galvanizing treatment an acidic galvanizing bath having the chemical composition given in (a) above added with Co, Sn and/or In in amounts shown in the first column of Table 1, under the conditions given in (b) above, to form a single galvanizing layer on the surface of said steel sheet. The bare corrosion resistance of the electro-galvanized steel sheet thus obtained was measured.

Then, said electro-galvanized steel sheet was subjected to a chromate treatment under the following conditions:

c. Conditions for chromate treatment

Chemicals:Solution made by Nihon Parkerizing Co., Ltd.,
Free acid (*F.A.):5.5 point,
Bath temperature:40°-50° C,
Treating time:4 sec;

(*F.A. point is an indication of the free acid concentration represented by the amount of NaOH consumption in ml, obtained by using brom cresol green, and by titrating 0.1 Normal-NaOH into a 5ml chromating solution);

and, the amount of deposited chromate film and the rust resistance of the chromated electro-galvanized steel sheet thus obtained were measured.

The results of these measurements mentioned above are also indicated in Table 1.

In Table 1, the bare corrosion resistance of a galvanizing layer was determined from the condition of red rust occurrence on an electro-galvanized steel sheet after the lapse of 36 hours in a salt spray test carried out in accordance with the Japanese Industrial Standard JIS.Z2371. The rust resistance of a chromated electro-galvanized steel sheet was judged from the condition of white rust occurrence after the lapse of 72 hours and the condition of red rust occurrence after the lapse of 288 hours in said salt spray test.

In Table 1, the mark *o* indicates "excellent"; *x*, "acceptable"; and xx, "unsatisfactory".

Table 1

| Example | Additive into acidic galvanizing bath and amount of addition for forming 1st galvanizing layer (ppm) | Additive into acidic galvanizing bath and amount of addition for forming 2nd galvanizing layer (ppm) | Bare corrosion resistance of galvanizing layer (36 hr. after) | Chromated electro-galvanized steel sheet: Amount of deposited chromate film (mg/m$^2$) | White rust resistance (72 hr. after) | Red rust resistance (288 hr. after) |
|---|---|---|---|---|---|---|
| 1 | No additive | Sn . . . 500 | o | 110 | o | o |
| 2 | " | In . . . 1,000 | o | 95 | o | o |
| 3 | " | $Cr^{3+}$ . . . 500 | o | 105 | o | o |
| 4 | " | $Cr^{6+}$ . . . 100<br>Sn . . . 500 | o | 110 | o | o |
| Comparison | | | | | | |
| 1 | No additive | Without 2nd electro-galvanizing treatment | x | 15 | xx | x |
| 2 | Sn . . . 500 | " | xx | 116 | o | o |
| 3 | In . . . 1,000 | " | xx | 90 | o | o |
| 4 | Co . . . 10,000 | " | o | 8 | xx | xx |

In Table 1 above, each of the electro-galvanized steel sheets in Examples 1 to 4 within the scope of the first process of the present invention has a dual galvanizing layer of an overall thickness of 18 g/m$^2$ comprising a first galvanizing layer (lower layer) of 17 g/m$^2$ thick and a second galvanizing layer (upper layer) of 1 g/m$^2$ thick, whereas, in Comparisons 1 to 4 outside the scope of the first process of the present invention, each of the electro-galvanized steel sheets has a single galvanizing layer with a thickness of 18 g/m$^2$ equal to the overall thickness of the above-mentioned two layers.

As is evident from Table 1, the electro-galvanized steel sheet of Comparison 1 having a single pure zinc galvanizing layer and the electro-galvanized steel sheet of Comparison 4 having a single Co-containing galvanizing layer have a very slight amount of deposited chromate film and a low white rust resistance after chromating; the electro-galvanized steel sheet of Comparison 2 having a single Sn-containing galvanizing layer and the electro-galvanized steel sheet of Comparison 3 having a single In-containing galvanizing layer show an unsatisfactory bare corrosion resistance.

In Comparisons 1 to 4 outside the scope of the first process of the present invention, in which a single galvanizing layer is formed by a single electro-galvanizing treatment, as mentioned above, it is impossible to obtain a chromated electro-galvanized steel sheet satisfying all the requirements regarding the bare corrosion resistance of the galvanizing layer, the amount of deposited chromate film and the corrosion resistance after chromating.

In Examples 1 to 4, in contrast, the chromated electro-galvanized steel sheets within the scope of the first process of the present invention, having the first galvanizing layer (lower layer) excellent in the bare corrosion resistance and the second galvanizing layer (upper layer) excellent in the adaptability to chromating, are sufficiently provided, as is clear from Table 1, with all the above-mentioned properties and shows excellent performances.

EXAMPLE B

Example B is an embodiment of the second process of the present invention.

A steel sheet was subjected to the first electro-galvanizing treatment in a bath prepared by adding Co in an amount indicated in the first column of Table 2 below into an acidic galvanizing bath having the chemical composition given in (a) of Example A mentioned above, under the conditions given in (b) of Example A, to form a first galvanizing layer on the surface of said steel sheet. Subsequently, said electro-galvanized steel sheet with said first galvanizing layer formed thereon was subjected to the second electro-galvanizing treatment in a bath prepared by adding $Cr^{3+}$, $Cr^{6+}$, Sn and/or In in amounts indicated in the second column of Table 2 below into an acidic galvanizing bath having the chemical composition given in (a) of Example A, under the conditions given in (b) of Example A, to form a second galvanizing layer on said first galvanizing layer. In Comparisons 4 and 5 in Table 2, however, a steel sheet was subjected, without applying the above-mentioned second electro-galvanizing treatment, to only a single electro-galvanizing treatment in an acidic galvanizing bath having the chemical composition given in (a) of Example A added with Co or $Cr^{6+}$ in amounts shown in the first column of Table 2, under the conditions given in (b) of Example A, to form a single galvanizing layer on the surface of said steel sheet. The bare corrosion resistance of the electro-galvanized steel sheet thus obtained was measured.

Then, said electro-galvanized steel sheet was subjected to a chromate treatment under the conditions given in (c) of Example A mentioned above, and, the amount of deposited chromate film and the rust resistance of the chromated electro-galvanized steel sheet thus obtained were measured.

The results of these measurements mentioned above are also indicated in Table 2. The measuring methods and the manner of representation of the results are the same as in Example A.

Table 2

| Example | Additive into acidic galvanizing bath and amount of addition for forming 1st galvanizing layer (ppm) | Additive into acidic galvanizing bath and amount of addition for forming 2nd galvanizing layer (ppm) | Bare corrosion resistance of galvanizing layer (36 hr. after) | Chromated electro-galvanized steel sheet: Amount of deposited chromate film ($mg/m^2$) | White rust resistance (72 hr. after) | Red rust resistance (288 hr. after) |
|---|---|---|---|---|---|---|
| 1 | Co . . . 8,000 | In . . . 1,000 | o | 147 | o | o |
| 2 | Co . . . 8,000 | $Cr^{6+}$ . . . 200 | o | 140 | o | o |
| 3 | Co . . . 3,000 | $Cr^{6+}$ . . . 100<br>Sn . . . 300 | o | 185 | o | o |
| 4 | Co . . . 3,000 | Sn . . . 800 | o | 160 | o | o |
| 5 | Co . . . 5,000 | $Cr^{3+}$ . . . 300 | o | 153 | o | o |
| Comparison | | | | | | |
| 1 | Co . . . 5,000 | In . . . 5<br>Sn . . . 5 | o | 60 | x | o |
| 2 | Co . . . 10 | $Cr^{6+}$ . . . 100<br>Sn . . . 300 | xx | 180 | o | x |
| 3 | Co . . . 5,000 | No additive | o | 55 | x | o |
| 4 | Co . . . 5,000 | Without 2nd electro-galvanizing treatment | o | 10 | xx | x |
| 5 | $Cr^{6+}$ . . . 300 | " | xx | 150 | o | o |

In Table 2 above, each of the electro-galvanized steel sheets in Examples 1 to 5 within the scope of the second process of the present invention and those of Comparisons 1 to 3 outside the scope of the second process of the present invention has a dual galvanizing layer of an overall thickness of 18 $g/m^2$ comprising a first galvanizing layer (lower layer) of 17 $g/m^2$ thick and a second galvanizing layer (upper layer) of 1 $g/m^2$ thick, whereas, in Comparisons 4 and 5 outside the scope of the second process of the present invention, each of the electro-galvanized steel sheets has a single galvanizing layer with a thickness of 18 $g/m^2$ equal to the overall thickness of the above-mentioned two layers.

As is clear from Table 2, the electro-galvanized steel sheet of Comparison 4 with a single Co-containing galvanizing layer, having a good bare corrosion resistance under the effect of added Co, shows a low white rust resistance and a low red rust resistance after chromating because of a very small amount of deposited chromate film. The electro-galvanized steel sheet of Comparison 5 with a single $Cr^{6+}$-containing galvanizing layer, having a good white rust resistance and a red rust resistance after chromating, shows a low bare corrosion resistance of the galvanizing layer. The electro-galvanizing steel sheets of Comparisons 1 to 3 have a dual galvanizing layer consisting of the first galvanizing layer (lower layer) and the second galvanizing layer (upper layer) as in the electro-galvanized steel sheets of Examples 1 to 5 within the scope of the second process of the present invention. In Comparison 1, however, the Co content in the acidic galvanizing bath for forming the first galvanizing layer is within the scope of the second process of the present invention, whereas the contents of In and Sn in the acidic galvanizing bath for forming the second galvanizing layer are too small, being outside the scope of the second process of the present invention; the electro-galvanized steel sheet in this case has consequently a good bare corrosion resistance of the galvanizing layer and a good red rust resistance after chromating, but has a relatively small amount of deposited chromate film and the white rust resistance after chromating is also problematic. In Comparison 2, in which the contents of $Cr^{6+}$ and Sn in the acidic galvanizing bath for forming the second galvanizing layer are within the scope of the second process of the present invention, while the Co content in the acidic galvanizing bath for forming the first galvanizing layer is too small, being outside the scope of the second process of the present invention, the bare corrosion resistance of the galvanizing layer is very low and the red rust resistance after chromating is also problematic, the only satisfactory property being the white rust resistance after chromating. The electro-galvanized steel sheet of Comparison 3 in which the Co content in the acidic galvanizing bath for forming the first galvanizing layer is within the scope of the second process of the present invention but the acidic galvanizing bath for forming the second galvanizing layer contains no additive, as in the case of Comparison 1 mentioned above, shows a satisfactory bare corrosion resistance of the galvanizing layer and a good red rust resistance after chromating, but has only a relatively small amount of deposited chromate film, and the white rust resistance after chromating is problematic.

As described above, in Comparisons 1 to 5 outside the scope of the second process of the present invention, it is impossible to obtain a chromated electro-galvanized steel sheet satisfying all the requirements regarding the bare corrosion resistance of the galvanizing layer, the amount of deposited chromate film and the corrosion resistance after chromating.

In contrast, the chromated electro-galvanized steel sheets of Examples 1 to 5 within the scope of the second process of the present invention, each having the first galvanizing layer (lower layer) excellent in the bare corrosion resistance and the second galvanizing layer (upper layer) excellent in the adaptability to chromating, are provided, as is clear from Table 2, with excellent properties satisfying all the above-mentioned requirements.

EXAMPLE C

Example C is an embodiment of the third process of the present invention.

A steel sheet was subjected to the first electro-galvanizing treatment in a bath prepared by adding Co and at least one of $Cr^{3+}$, $Cr^{6+}$ and Zr in amounts indicated in the first column of Table 3 below into an acidic galvanizing bath having the chemical composition shown in (a) of Example A mentioned above, under the conditions given in (b) of Example A, to form a first galvanizing layer on the surface of said steel sheet. Then, said electro-galvanized steel sheet with said first galvanizing layer formed thereon was subjected to the second electro-galvanizing treatment in a bath prepared by adding $Cr^{3+}$, $Cr^{6+}$, Sn and/or In in amounts indicated in the second column of Table 3 below into an acidic galvanizing bath having the chemical composition shown in (a) of Example A, under the conditions given in (b) of Example A, to form a second galvanizing layer on said first galvanizing layer. In comparisons 1 to 5 of Table 3, however, a steel sheet was subjected, without applying the above-mentioned second electro-galvanizing treatment, to only a single electro-galvanizing treatment in an acidic galvanizing bath having the chemical composition given in (a) of Example A added with elements in amounts indicated in the first column of Table 3, under the conditions given in (b) of Example A to form a single galvanizing layer on the surface of said steel sheet. The bare corrosion resistance of the electro-galvanized steel sheet thus obtained was measured.

Thus, said electro-galvanized steel sheet was subjected to a chromate treatment under the conditions given in (c) of Example A above, and, the amount of deposited chromate film and the rust resistance of the chromated electro-galvanized steel sheet thus obtained were measured.

The results of these measurements mentioned above are also indicated in Table 3. The measuring methods and the manner of representation of the results are the same as in Example A.

Table 3

| Example | Additive into acidic galvanizing bath and amount of addition for forming 1st galvanizing layer (ppm) | Additive into acidic galvanizing bath and amount of addition for forming 2nd galvanizing layer (ppm) | Bare Corrosion resistance of galvanizing layer (36 hr. after) | Chromated electro-galvanized steel sheet: Amount of deposited chromate film ($mg/m^2$) | White rust resistance (72 hr. after) | Red rust resistance (288 hr. after) |
|---|---|---|---|---|---|---|
| 1 | Co . . . 5,000<br>$Cr^{6+}$ . . . 100 | $Cr^{3+}$ . . . 500 | o | 130 | o | o |
| 2 | Co . . . 5,000<br>$Cr^{6+}$ . . . 100 | Sn . . . 500 | o | 155 | o | o |
| 3 | Co . . . 5,000<br>$Cr^{6+}$ . . . 100 | In . . . 1,000 | o | 160 | o | o |
| 4 | Co . . . 5,000<br>$Cr^{6+}$ . . . 100 | $Cr^{6+}$ . . . 100<br>Sn . . . 500 | o | 190 | o | o |
| 5 | Co . . . 5,000<br>Zr . . . 2,000 | $Cr^{6+}$ . . . 100<br>Sn . . . 500 | o | 180 | o | o |
| Comparison | | | | | | |
| 1 | No additive | Without 2nd electro-galvanizing treatment | x | 51 | xx | x |
| 2 | Co . . . 5,000 | " | o | 9 | xx | x |
| 3 | Co . . . 5,000<br>Zr . . . 2,000 | " | o | 17 | x | o |
| 4 | Sn . . . 5,000 | " | xx | 162 | o | o |
| 5 | In . . . 1,000 | " | xx | 150 | o | o |
| 6 | $Cr^{6+}$ . . . 100 | Co . . . 5,000<br>$Cr^{6+}$ . . . 100 | x | 20 | xx | xx |

In Table 3 above, each of the electro-galvanized steel sheets in Examples 1 to 5 within the scope of the third process of the present invention and that in Comparison 6 outside the scope of the third process of the present invention has a dual galvanizing layer of an overall thickness of 18 g/m² comprising a first galvanizing layer (lower layer) of 17 g/m² thick and a second galvanizing layer (upper layer) of 1 g/m² thick, whereas, in Comparisons 1 to 5 outside the scope of the third process of the present invention, each of the electro-galvanized steel sheets has a single galvanizing layer with a thickness of 18 g/m² equal to the overall thickness of the above-mentioned two layers.

As is evident from Table 3, the electro-galvanized steel sheet of Comparison 1 with a single pure zinc galvanizing layer has a relatively small amount of deposited chromate film and is very low in the white rust resistance after chromating. The electro-galvanized steel sheet of Comparison 2 having a single Co-containing galvanizing layer and the electro-galvanized steel sheet of Comparison 3 having a single galvanizing layer containing Co and Zr, which show a satisfactory bare corrosion resistance under the effect of the added Co, have only a very small amount of deposited chromate film and are low in the white rust resistance after chromating. The electro-galvanized steel sheets of Comparisons 4 and 5 having a single galvanizing layer containing Sn or In show a high white rust resistance and red rust resistance after chromating, but are low in the bare corrosion resistance of the galvanizing layer. The electro-galvanized steel sheet of Comparison 6 has a dual galvanizing layer comprising the first galvanizing layer (lower layer) and the second galvanizing layer (upper layer), as in the electro-galvanized steel sheets of Examples 1 – 5 within the scope of the third process of the present invention. However, the acidic galvanizing bath for forming the first galvanizing layer in Comparison 6 does not contain Co which is indispensable in the third process of the present invention, and the acidic galvanizing bath for forming the second galvanizing layer contains Co which should not be added in the third process of the present invention. As a result, the electro-galvanized steel sheet of Comparison 6, showing a slightly unsatisfactory bare corrosion resistance, has a very small amount of deposited chromate film, and is very low in the white rust resistance and the red rust resistance after chromating.

As mentioned above, in Comparisons 1 to 6 outside the scope of the third process of the present invention, it is impossible to obtain a chromated electro-galvanized steel sheet satisfying all the requirements regarding the bare corrosion resistance of the galvanizing layer, the amount of deposited chromate film and the corrosion resistance after chromating.

In contrast, the chromated electro-galvanized steel sheets of Examples 1 to 5 within the scope of the third process of the present invention, each having the first galvanizing layer (lower layer) excellent in the bare corrosion resistance and the second galvanizing layer (upper layer) excellent in the adaptability to chromating, are provided, as is clear from Table 3, with excellent properties satisfying all the above-mentioned requirements.

According to the present invention, as described above in detail, it is possible to obtain a chromated electro-galvanized steel sheet excellent in the bare corrosion resistance of the galvanizing layer and the corrosion resistance after chromating and less susceptible of secular degradation of the deep-drawing formability, under the combined effect of the first galvanizing layer (lower layer) excellent in the bare corrosion resistance and the second galvanizing layer (upper layer) excellent in the adaptability to chromating. Even when the disadvantages in operation and in costs in adding various elements into the acidic galvanizing bath are taken into account, the improvement in the product quality well exceeds these drawbacks.

Furthermore, because a chromated electro-galvanized steel sheet obtained in accordance with the present invention has an excellent corrosion resistance as mentioned above, it is possible, even when a corrosion resistance equal or superior to that of a conventional pure zinc galvanized steel sheet is required, to reduce the amount of deposited zinc as compared with conventional one, and this permits increasing the galvanizing speed, thus providing industrially useful effects.

What is claimed is:

1. A process for manufacturing a chromated electrogalvanized steel sheet which comprises subjecting a steel sheet to an electro-galvanizing treatment, and then subjecting said electro-galvanized steel sheet to a chromate treatment, characterized by:

subjecting a steel sheet to a first electro-galvanizing treatment under galvanizing conditions in an acidic galvanizing bath selected from the group consisting of:

A. an acidic galvanizing bath in which zinc is the sole galvanizing metal;

B. galvanizing bath (A) containing an additive capable of improving the bare corrosion resistance of a galvanizing layer formed on the surface of said steel sheet, said additive consisting essentially of 50 – 10,000 ppm Co; and C. galvanizing bath (B) containing at least one additive having said capability and being selected from the group consisting of:

| | |
|---|---|
| i. $Cr^{3+}$ | 50 – 700 ppm, |
| ii. $Cr^{6+}$ | 50 – 500 ppm, |
| iii. $Cr^{3+}$ and $Cr^{6+}$ | 50 – 700 ppm, in which the maximum of $Cr^{6+}$ is 500 ppm, |

and

| | |
|---|---|
| iv. Zr | 10 – 2,500 ppm, |

to form on the surface of said steel sheet a first galvanized layer which is excellent in bare corrosion resistance; then, subjecting said electro-galvanized steel sheet with said first galvanized layer formed thereon to a second electro-galvanizing treatment under galvanizing conditions in an additive-containing Zn-based acidic galvanizing bath the additive thereof being capable of improving the adaptability of a galvanized layer to chromating and consisting essentially of at least one selected from the group consisting of:

| | |
|---|---|
| a. $Cr^{3+}$ | 50 – 700 ppm, |
| b. $Cr^{6+}$ | 50 – 500 ppm, |
| c. $Cr^{3+}$ and $Cr^{6+}$ | 50 – 700 ppm, in which the maximum of $Cr^{6+}$ is 500 ppm, |

d. Sn 10 - 5,000 ppm, and e. In 10 - 3,000 ppm, to form on said first galvanized layer a second galvanized layer in an amount of at least 0.2 g/m², said second galvanized layer being excellent in adaptability to chromating; and then, subjecting said electro-galvanized steel sheet with said first and said second galvanized layers formed thereon to a chromate treatment to form a chromate film on said second galvanized layer.

2. Process of claim 1, wherein the bath in the second electro-galvanizing treatment is a zinc-based acidic galvanizing bath containing an additive providing from 50 to 500 ppm $Cr^{6+}$ and 10 to 5,000 ppm Sn.

3. Process of claim 1, wherein the bath in the first electro-galvanizing treatment is (A).

4. Process of claim 1, wherein the bath in the first electro-galvanizing treatment is (B).

5. Process of claim 1, wherein the bath in the first electro-galvanizing treatment is (C).

6. Process of claim 1, wherein the bath in the first electro-galvanizing treatment is (C)(ii).

7. Process of claim 1, wherein the bath in the first electro-galvanizing treatment is (C)(iii).

8. Process of claim 1, wherein the bath in the first electro-galvanizing treatment is (C)(iv).

9. Process of claim 1, wherein the bath in the second electro-galvanizing treatment is a zinc-based acidic galvanizing bath containing an additive providing from 50 to 700 ppm $Cr^{3+}$.

10. Process of claim 1, wherein the bath in the second electro-galvanizing treatment is a zinc-based acidic galvanizing bath containing an additive providing from 50 to 500 ppm $Cr^{6+}$.

11. Process of claim 1, wherein the bath in the second electro-galvanizing treatment is a zinc-based acidic galvanizing bath containing additives providing from 50 to 700 ppm $Cr^{3+}$ and $Cr^{6+}$, the maximum quantity of $Cr^{6+}$ therein being 500 ppm.

12. Process of claim 1, wherein the bath in the second electro-galvanizing treatment is a zinc-based acidic galvanizing bath containing an additive providing from 10 to 5,000 ppm Sn.

13. Process of claim 1, wherein the bath in the second electro-galvanizing treatment is a zinc-based acidic galvanizing bath containing an additive providing from 10 to 3,000 ppm In.

14. A chromated electro-galvanized steel sheet characterized by comprising:

a steel sheet; a first electro-galvanized layer, serving as the main layer, formed on the surface of said steel sheet, selected from the group consisting of:

A. an electro-galvanized layer consisting essentially of Zn;

B. a Zn-based electro-galvanized layer consisting essentially of zinc and at least one of the oxides and the hydroxides of Co; and C. a Zn-based electro-galvanized layer consisting essentially of zinc and at least one of the oxides and the hydroxides of Co and at least one of the oxides and the hydroxides of Cr and Zr;

a second Zn-based electro-galvanized layer in an amount of at least 0.2 g/m², the said second layer consisting essentially of zinc and at least one oxide or hydroxide of a metal consisting essentially of a metal selected from the group consisting of Cr, Sn and In, formed on said first electro-galvanized layer; and a chromate film formed on said second electro-galvanized layer.

15. Steel sheet of claim 14, wherein the second layer consists essentially of a Cr oxide or hydroxide and a Sn oxide or hydroxide.

16. Steel sheet of claim 14, wherein the first layer consists of zinc.

17. Steel sheet of claim 14, wherein the first layer consists essentially of zinc and a Co oxide or hydroxide.

18. Steel sheet of claim 14, wherein the first layer consists essentially of zinc, a Co oxide or hydroxide and either a Cr or Zr oxide or hydroxide.

19. Steel sheet of claim 14, wherein the second layer contains a Cr oxide or hydroxide.

20. Steel sheet of claim 14, wherein the second layer contains Sn oxide or hydroxide.

21. Steel sheet of claim 14, wherein the second layer contains a In oxide or hydroxide.

* * * * *

UNITED STATES PATENT AND TRADEMARK OFFICE

CERTIFICATE OF CORRECTION

PATENT NO. : 4,064,320

DATED : December 20, 1977

INVENTOR(S) : TAKESHI ADANIYA et al

It is certified that error appears in the above-identified patent and that said Letters Patent are hereby corrected as shown below:

Column 3, line 48: replace "containg" with ---containing---.

Column 5, lines 23 and 29: rewrite "electrogalvanized" as ---electro-galvanized---.

Column 5, line 51: rewrite "presense" as ---presence---.

Column 6, line 7: replace "bar" with ---bare---.

Column 6, line 29: after "$Cr^{6+}$", delete "13".

Column 7, line 11: rewrite "electrogalvanizing" as ---electro-galvanizing---.

Column 7, line 46: replace "layed" with ---layer)---.

Column 13, line 40: rewrite "galvanizng" as ---galvanizing---.

Column 13, line 42: after "50-", delete "0".

Column 13, lines 50-55: the phrase "into an acidic... first process of the present invention" should be printed as a separate paragraph.

Column 22, lines 16-17 (Claim 1): rewrite "electrogalvanized" as ---electro-galvanized---.

UNITED STATES PATENT AND TRADEMARK OFFICE

CERTIFICATE OF CORRECTION

PATENT NO. : 4,064,320

DATED : December 20, 1977

INVENTOR(S) : TAKESHI ADANIYA et al

It is certified that error appears in the above-identified patent and that said Letters Patent are hereby corrected as shown below:

Column 22, line 29 (Claim 1): replace "galvanizing" with ---galvanized---.

Column 23, line 15 (Claim 2): replace "an additive" with ---additives---.

Column 23, line 22 (Claim 5): replace "(C)" with ---(C)(i)---.

Column 24, line 30 (Claim 15): before "a Cr oxide", insert ---zinc and---.

Column 24, line 40 (Claim 19): replace "contains" with ---consists essentially of zinc and---.

Column 24, line 42 (Claim 20): replace "contains" with ---consists essentially of zinc and---.

UNITED STATES PATENT AND TRADEMARK OFFICE

CERTIFICATE OF CORRECTION

PATENT NO. : 4,064,320

DATED : December 20, 1977

INVENTOR(S) : TAKESHI ADANIYA et al

It is certified that error appears in the above-identified patent and that said Letters Patent are hereby corrected as shown below:

Column 24, line 44 (Claim 21): replace "contains" with ---consists essentially of zinc and---.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*